US005692660A

United States Patent [19]

Stewart

[11] Patent Number: 5,692,660

[45] Date of Patent: Dec. 2, 1997

[54] REVERSIBLE ARTICLE-CARRYING BAG

[76] Inventor: Michael A. Stewart, 22345 LaPalma Ave., Unit 102, Yorba Linda, Calif. 92687

[21] Appl. No.: 601,128

[22] Filed: Feb. 14, 1996

[51] Int. Cl.[6] ..... A45C 7/00

[52] U.S. Cl. ..... 224/581; 190/103; 383/2

[58] Field of Search ..... 224/581, 582, 224/577–9, 153, 575, 151; 190/15.1, 103, 104, 112; 383/4, 38, 117, 2

[56] References Cited

U.S. PATENT DOCUMENTS

| | | | |
|---|---|---|---|
| 1,207,533 | 12/1916 | Gamble | 190/103 |
| 2,497,325 | 2/1950 | Scherba . | |
| 2,552,443 | 5/1951 | Molinari . | |
| 3,202,191 | 8/1965 | Kaplan . | |
| 3,292,747 | 12/1966 | Dawson | 383/2 X |
| 3,746,066 | 7/1973 | McIntyre | 383/2 X |
| 3,838,758 | 10/1974 | Brown . | |
| 4,127,155 | 11/1978 | Hydorn . | |
| 4,153,146 | 5/1979 | Patton et al. | 190/103 |
| 4,613,039 | 9/1986 | Shaw et al. | 190/103 X |
| 4,830,154 | 5/1989 | Gerch et al. . | |
| 5,047,001 | 9/1991 | Willis . | |
| 5,187,823 | 2/1993 | Ferguson et al. . | |
| 5,207,508 | 5/1993 | Koutsis, Jr. . | |
| 5,288,150 | 2/1994 | Bearman . | |
| 5,490,619 | 2/1996 | Boyar | 224/581 |

FOREIGN PATENT DOCUMENTS

| | | | |
|---|---|---|---|
| 351371 | 2/1961 | Switzerland | 383/2 |

*Primary Examiner*—Renee S. Luebke

*Attorney, Agent, or Firm*—Kolisch Hartwell Dickinson McCormack & Heuser

[57] ABSTRACT

An article-carrying bag includes a first bag having a top defining a first bag opening, a closed bottom, and a central body portion extending between the top and bottom, a second bag having a top defining a second bag opening, a bottom, and a central body portion extending between the top and bottom, and a joinder line connecting the top of the first bag adjacent the bottom of the second bag such that the bags are capable of being configured in plural configurations including one in which the first bag extends away from the second bag and both openings face the same direction for defining a singular enclosure for receiving and holding articles, and another configuration in which the first bag may be stuffed into the second bag so the bag openings face opposite directions for defining separate enclosures for receiving and holding articles. Each separate enclosure prevents its respective held articles from commingling with articles in the other enclosure. A closure member is preferably connected adjacent each bag top for enabling one or both of the bags to be closed. Preferably, the closure member includes an elongate strap and a collar which is connected adjacent at least one of the bag tops for receiving a portion of the strap which permits the bag top to be gathered therealong for closing. In the preferred embodiment, two collars are provided, the first bag is waterproof or water resistant, and the second bag is mesh.

24 Claims, 4 Drawing Sheets

10
12
14
16
18
20
22
24
26
28
30
30a
32
32a
34

REVERSIBLE ARTICLE-CARRYING BAG

BACKGROUND AND SUMMARY OF THE INVENTION

This invention relates generally to article-carrying bags, and more particularly it concerns an article-carrying bag which may be placed in a number of configurations for carrying articles of various types. At least one of the configurations is characterized by plural article-carrying compartments which hold and maintain articles and prevent articles, as between compartments, from commingling.

Bags for carrying articles are well known and come in many shapes and sizes. One such bag is disclosed in U.S. Pat. No. 2,552,443 to Molinari which shows an open-ended shopping bag with one end permanently closed. A series of spaced rings are secured to the edge of the open end, and a drawstring is looped through the rings and through another ring at the bottom of the bag for enabling an individual to close off the bag at will. The drawstring enables an individual to carry the bag by looping the same around the individual's shoulder. A significant problem with Molinari is that articles which are carried in the bag may commingle with one another so that if an individual wanted to keep such articles separate from one another, they would be unable to do so. Say for instance, an individual has both wet and dry articles they want to transport from one place to another, and they want to prevent the dry articles from becoming wet. Molinari's bag would not allow an individual to transport such articles together without the dry articles becoming wet. This is because the articles would be allowed to commingle with one another. Thus, Molinari is particularly limited in utility.

A bag which allows for articles to be carried in a manner which maintains a separation between certain of the articles is disclosed in U.S. Pat. No. 2,497,325 to Scherba which discloses a shoe bag with a partition-forming extension which divides the bag into two separate compartments, one each for carrying a separate shoe. Scherba's bag is significantly limited in utility because the partition-forming extension is stitched in place so that the bag is configurable in only one carrying configuration.

Another bag, one of a so-called tote variety, is disclosed in U.S. Pat. No. 5,288,150 to Bearman which describes a tote bag with an inner lining of mesh material which is accessible through a primary opening for use in placing or removing articles in (from) the bag. An outer lining is fastened to the inner lining at the periphery of the primary opening. A secondary opening is provided at the lower portion of the outer lining. The primary opening allows articles which are wet and contain sand and other debris to be deposited into the inner lining so that the articles are suspended inside of the outer lining, and when carried from one place to another, sand and other debris is shaken loose and allowed to fall freely through the mesh inner lining for collection by the outer lining. Because the secondary opening in the lower portion of the outer lining may be closed, sand and other material may not escape the bag. The secondary opening may be opened once the majority of the sand has fallen away from the carried articles so that the sand may be disposed of properly. Bearman's bag is extremely limited in utility because only one type of article may be carried by the bag. More specifically, one may carry articles which are only wet (sandy) or only dry, but not both. This is because such articles may not be separated when carried and would effectively commingle thereby transferring water and/or sand from wet and sandy articles to the carried dry articles.

With the above problems in mind, it is a general object of the present invention to provide an article-carrying bag which is capable of being placed in plural, article-carrying configurations, one of which defines plural carrying compartments which are capable of holding and maintaining articles in a segregated manner.

It is another object of the invention to provide a multi-configurable, article-carrying bag which is capable of carrying both soiled and unsoiled articles, without the unsoiled articles coming into contact with the soiled articles.

It is yet another object to provide an article carrying bag which is capable of being placed in at least two article-carrying configurations which are different from one another, and which includes means for carrying the bag which allow multiple carrying configurations.

It is yet another object of the invention to provide an article-carrying bag which is rugged, durable, and easy and inexpensive to manufacture.

In brief summary, the invention achieves these and other objects in the form of an article-carrying bag which includes a first bag having a top defining a first bag opening, a closed bottom, and a central body portion extending between the top and bottom. A second bag includes a top defining a second bag opening, a bottom, and a central body portion extending between the top and bottom. A joinder line connects the top of the first bag adjacent the bottom of the second bag so that the bags are capable of being configured in plural configurations including one in which the first bag extends away from the second bag and both openings face the same direction for defining a singular enclosure for receiving and holding articles. The joinder between the bags allows another configuration in which the first bag may be stuffed into the second bag so the bag openings face opposite directions for defining separate enclosures for receiving and holding articles. Each separate enclosure prevents its respective held articles from commingling with articles in the other enclosure.

According to one feature of the invention, a closure member is connected adjacent each bag top for enabling one or both of the bags to be closed. In one embodiment, the closure member includes an elongate strap, and a collar which is connected adjacent at least one of the bag tops for receiving a portion of the strap and permitting the bag top to be gathered therealong for closing. In the preferred embodiment, two collars are provided, each being connected to a separate bag top, and the strap passes through each respective collar and enables the respective bag top to be gathered therealong for closing.

According to another feature of the invention, the first bag is constructed from a material which is waterproof, and the second bag is constructed from a mesh material which allows both wet or soiled articles to be carried along with dry or unsoiled articles, without the dry articles becoming wet or soiled.

These and other objects and advantages of the invention will become more clearly understood as the description which follows is read in conjunction with the accompanying drawings.

DETAILED DESCRIPTION OF THE PREFERRED AND ALTERNATE EMBODIMENTS

Figures 1, 1A, 1B, 1C:
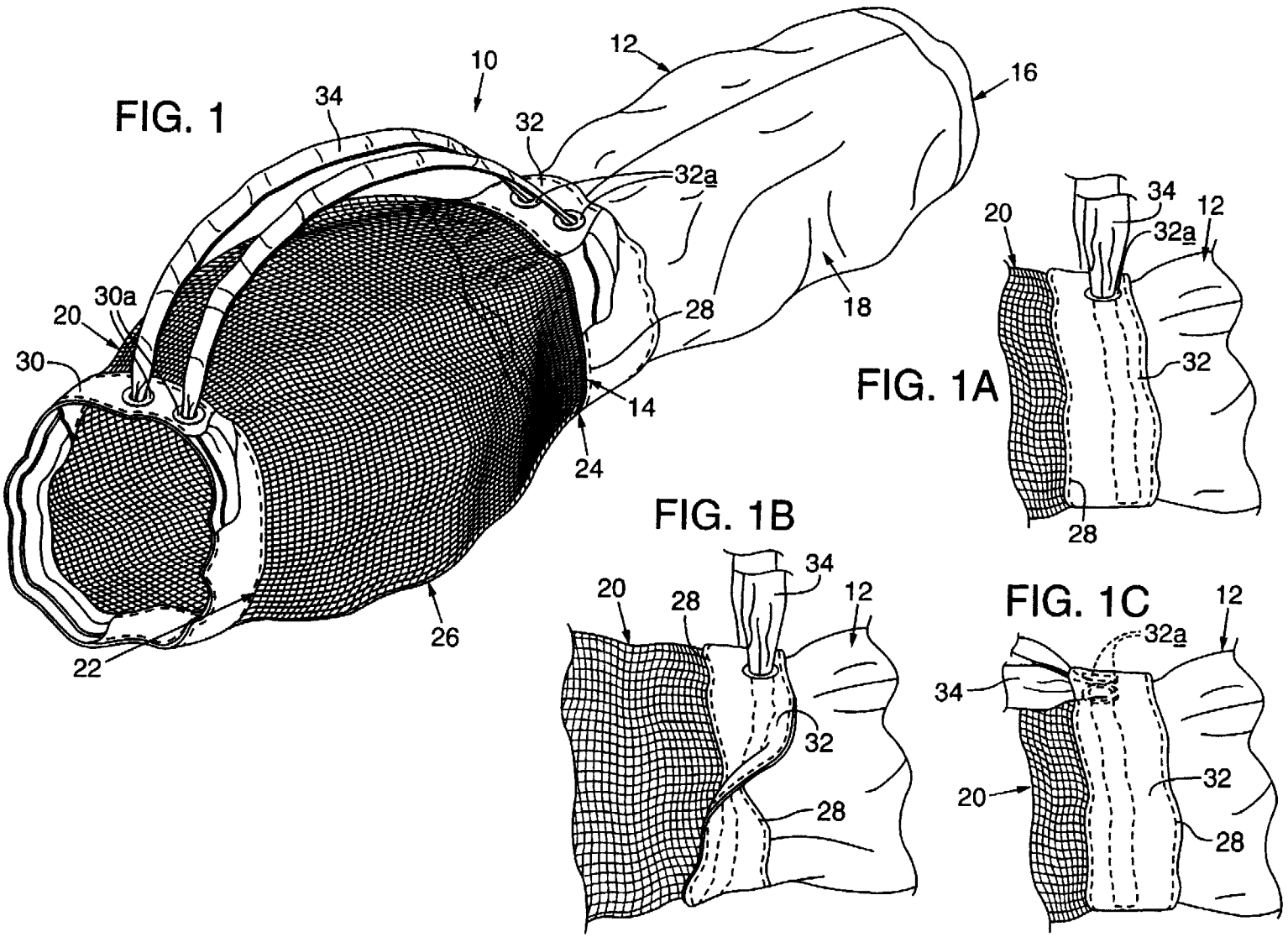
FIG. 1 is an isometric elevated view of an article-carrying bag according to the preferred embodiment of the present invention, the bag being shown in a so-called starting configuration.
FIG. 1A is a side plan view of a central portion of the article-carrying bag of FIG. 1.
FIG. 1B is a side plan view of the central portion shown in FIG. 1A, with a portion of the joinder region folded over.
FIG. 1C is a side plan view of the central portion shown in FIG. 1A, with the joinder region completely folded over.

As shown in FIG. 1, an article-carrying bag according to the present invention is generally indicated at 10. Bag 10 provides a useful article-carrying bag which is capable of being placed by a user in multiple article-carrying configurations which accommodate different circumstances. Each of FIGS. 1, 2, 3 and 4 show a separate configuration into which the bag 10 may be placed, each of which and its advantages being discussed in detail below.

FIG. 1 shows that bag 10 includes a first bag 12 having a top 14 defining a first bag opening, a closed bottom 16, and a central body portion 18 which extends between top 14 and bottom 16. A second bag 20 includes a top 22 defining a second bag opening, a bottom 24, and a central body portion 26 which extends between top 22 and bottom 24. The bags are preferably constructed from collapsible fabric material, and bag 12 is preferably constructed from material which is water-resistant, and bag 20 is preferably constructed from a mesh material for reasons which will become evident below. It will be appreciated, however, that the bags may be constructed from the same material. A joinder line 28 directly connects first bag top 14 adjacent second bag bottom 24 as shown, for a purpose discussed below. The joinder line is preferably a sewn stitching which circumscribes the top 14 and bottom 24, although any suitable manner of joining the bags would suffice.

Figure 2A:
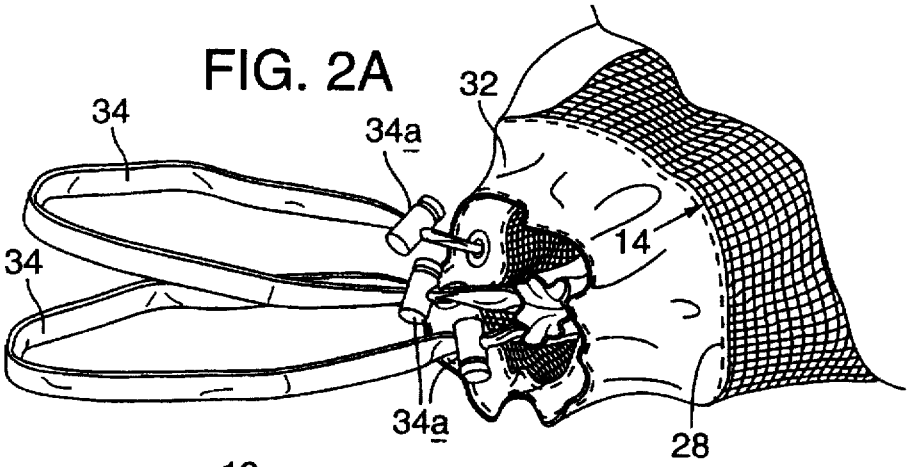
FIG. 2A shows just the top of the bag shown in FIG. 2, the bag having been closed by a closure member.

Bag 10 is equipped with a closure member which, preferably, includes two collar-like sleeves 30, 32 (also referred to herein as collars 30, 32) and a strap 34 connecting the sleeves. Each sleeve or collar is connected to a respective bag top and receives a portion of strap 34 which permits each bag top to be gathered or cinched therealong for closing off the bag, or more particularly, a portion of the bag. The sleeves 30, 32, are referred to as such because of the way each is mounted adjacent its respective bag top, and the function it performs. More specifically, as shown in FIG. 1, each sleeve loops circuitously around a section of bag 10 and defines a collar which bounds the respective bag top to which it is connected. Furthermore, each defines a sleeve-like passageway for strap 34 which may be seen internally of each respective sleeve where sleeve portions have been broken away to show the strap. The entrances and exits of each sleeve are defined by eyelet or grommet pairs 30*a*, 32*a*, respectively. As is most evident from FIG. 1A, grommet pair 32*a* are spaced from joinder line 28, and closer to the side of sleeve 32 which is opposite the joinder line for a purpose discussed below. Strap 34, which is preferably an elongate, continuous run of sturdy strap material such as nylon, passes through each eyelet and loops around the bag, through each respective sleeve, and permits the respective bag top to which it is connected to be gathered therealong for closing. Sleeve 32 is shown in FIG. 2A having been gathered or cinched along strap 34.

In the preferred embodiment, the strap loops around two bag sections which are spaced from one another so that two runs of the strap are exposed and extend between the collars or sleeves 30, 32, for defining carrying straps which allow the bag to be carried in a number of different ways which are discussed below. It will be understood, however, that the above-described closure member, and more specifically, sleeves 30, 32 are intended as the preferred embodiment and are not meant to limit the invention. More to the point, other closure members could be used and are considered as being within the spirit and scope of the invention. For example, a series of rings could be mounted about the peripheries of each respective bag opening 14, 22, for receiving strap 34 and functioning as described above and below. Alternatively, bag 10 may have separate closure elements instead of the collars described above, e.g., zippers, loop-and-pile fasteners, snaps, button/hole pairs, latches of any type etc. . . . , and the strap may be fastened to the bag independently of the closure elements so that the bag may be carried as described below.

Collar 32 is shown in FIG. 1 as being somewhat wider than collar 30 along the longitudinal dimension of the bag. Preferably, collar 32 is slightly under four-inches in width and collar 30 is slightly under two-inches in width. The width of collar 32 and the spacing of the grommets thereon serve a purpose which is discussed just below. Referring now to FIG. 1A, the reader will see that joinder line 28 and collar 32 define what may be considered a region of joinder which enables the bag 10 to be configured and closed in the multiple configurations which are discussed just below. Before the configurations are described, however, a description of the joinder region is in order.

The joinder region and the orientations into which it may be placed for effecting the multiple bag configurations mentioned above, are shown in more detail in FIGS. 1A–1C. FIGS. 1A–1C show a serial progression through which collar 32 is moved. FIG. 1A shows collar 32 oriented generally as it appears in FIG. 1, with the grommets 32*a* (only one of which is shown) facing upwardly and outwardly. As shown, joinder line 28 is nearest bag 20, and collar 32 forms a flap which may be folded over the joinder line (to the left as viewed in FIG. 1A) as shown in FIG. 1B, so that the orientation of FIG. 1C may be achieved. FIG. 1B shows collar 32 in a halfway-folded-over position with the joinder line 28 specifically designated twice: first, at the upper part of collar 32 nearest bag 20, and second at the lower part of collar 32 nearest bag 12. FIG. 1C shows collar 32 flipped completely over the joinder line so that the joinder line now bounds bag 12, grommets 32*a* lie facing downwardly, and strap 34 emerges from the space between collar 32 and bag 20. As mentioned above, the joinder region and the particular way it connects bags 12, 20 enable bag 10 to be placed into the multiple configurations which will now be described.

A first configuration is shown in FIG. 1, and defines what may be considered a starting configuration because it is from this configuration that each of the subsequent configurations described below may be achieved.

In the first configuration, first bag 12 is extended away from second bag 20, and both bag tops or openings face the same direction for defining, if desired, a singular enclosure for receiving, holding, and carrying articles. The single enclosure may be considered a primary article-carrying compartment because in this configuration, the largest unrestricted volume is available for carrying articles. By "unrestricted" is meant that the entire volume of bag 10 is available, if so desired, for defining a single, primary carrying compartment. If only the primary carrying compartment were desired to be used, then one would only need to cinch the bag at collar 30 to effect bag closure. Of course, two separate enclosures could be achieved by simply cinching the bag at both collars. The starting configuration would be most ideal for carrying articles which are elongate and require an extra length of bag such as skateboards, beach umbrellas, poles (such as those which support volleyball nets), golf clubs, snowboards, bodyboards and the like.

Figure 2:
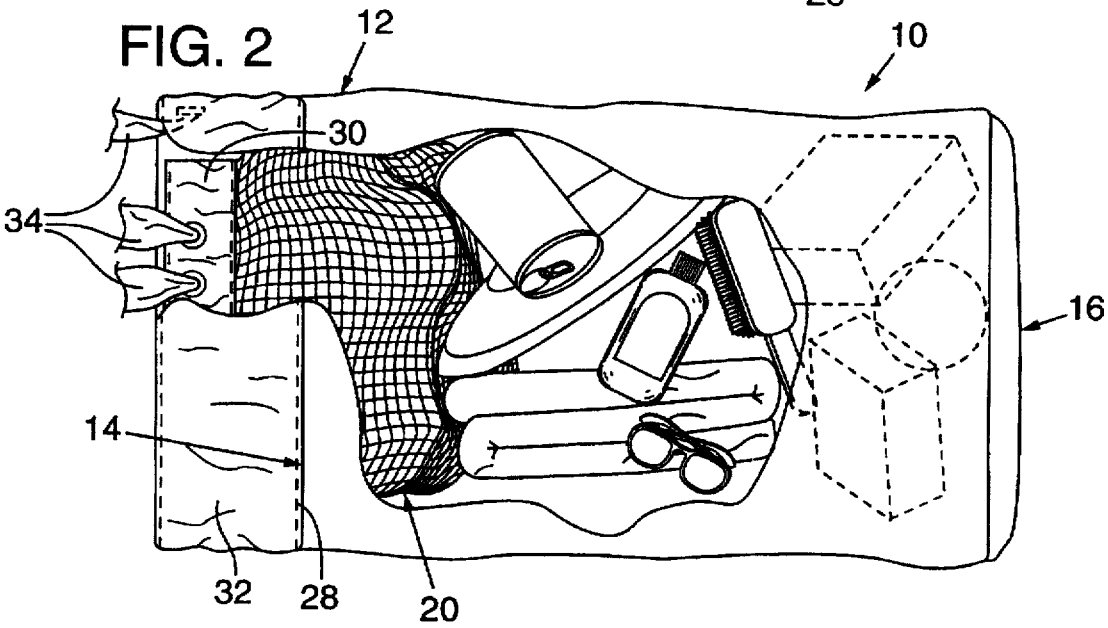
FIG. 2 is a side plan view of the bag of FIG. 1 which shows a bag configuration which is different from the one shown in FIG. 1. A portion of the bag has been broken away to show detail.

A second configuration is shown in FIG. 2, and is one in which second bag 20 has been stuffed into first bag 12 and on top of articles carried therein which include such things as sunglasses, suntan lotion, a towel, a beverage container, and the like. A portion of bag 12 has been broken away to show this extra detail. The second configuration is useful for carrying articles which do not require the extra length afforded by the first or starting configuration. Additionally, in the preferred embodiment, bag 12 is constructed from a water-resistant or waterproof material so that articles carried in the bag when so configured would be protected from rain, wind, and the like. In order to place the bag in the second configuration for carrying articles, one would first orient the bag as shown in FIG. 1, insert the to-be-carried articles into top 22 of bag 20, through the central body portion 26, and into bag 12 through opening 14, which as shown, faces the same direction as top 22. Then, one need only flip collar 32 over joinder line 28 as described above and shown collectively in FIGS. 1A–1C, and stuff mesh bag 20 into the top 14 of bag 12, as shown in FIG. 2. Now, with mesh bag 20 in place, bag 12 may be closed via strap 34, as shown in FIG. 2A, for carrying articles. It is perhaps easiest to close the bag by placing one hand on collar 32 adjacent the grommets and pulling gently on the strap. This permits the collar, and hence the bag top, to be gathered therealong for cinching or closing off the bag. An additional feature of the bag is shown in FIG. 2A at **34*a* where the reader will notice three so-called slide fasteners (the fourth fastener is obscured from view by strap 34), which are connected onto respective portions of strap 34 and prevent the bag from becoming uncinched once it is closed. More specifically, as the collar is gathered along the strap during closure, portions of strap 34 which were formerly located interiorly of the collar become exposed. Slide fasteners 34*a* permit a user of the bag to slide each respective fastener to a location closely adjacent a grommet so that the now-exposed strap portions cannot be retracted into the collar. In this way, the bag may be securely cinched. It will be appreciated that any suitable slide fasteners could be used. Such slide fasteners would naturally include ones which are spring-loaded, or constructed from material, such as fabric, formed into loops and dimensioned so that each strap is firmly engaged thereby. Additionally, the slide fasteners which are associated with common grommet pairs may be joined together to ensure against slippage. In the just-described configuration, the mesh bag functions, in part, to maintain the articles in bag 12 by blocking opening or top 14 and preventing the articles from working themselves out of the bag. In addition to being retained in the bag by the somewhat crumpled-up mesh bag, the articles are also retained because top 14 may be closed off by the strap so that an added degree of closure is provided. It will be appreciated that a slight modification of the second configuration provides a bag with an inner mesh lining into which articles may be deposited for carrying. More to the point and referring specifically to FIG. 2, if one removes all of the shown articles from the bag, the mesh bag 20 may be stuffed all of the way into bag 12 so that the mesh bag's collar 30 resides at a location which is closer to bottom 16 of bag 12. By cinching collar 30, an inner carrying compartment of mesh is created and articles may be carried in the mesh bag, suspended within bag 12. This would be useful in situations where one wanted to carry both wet and dry articles together without commingling therebetween. For example, if one placed wet articles in bag 12 before the mesh bag was stuffed inside, once the mesh bag was stuffed inside and closed as described above, dry articles could be placed in the mesh bag and carried in a suspended manner above the wet articles. In such a configuration, the articles carried in the mesh bag would be spaced from the wet articles a distance which is at least as far as the length of collar 30, and perhaps more depending on the length of the mesh bag. It will further be understood that the bag would be capable of being carried in the manners described below by simply lengthening strap 34**.

Figure 3:
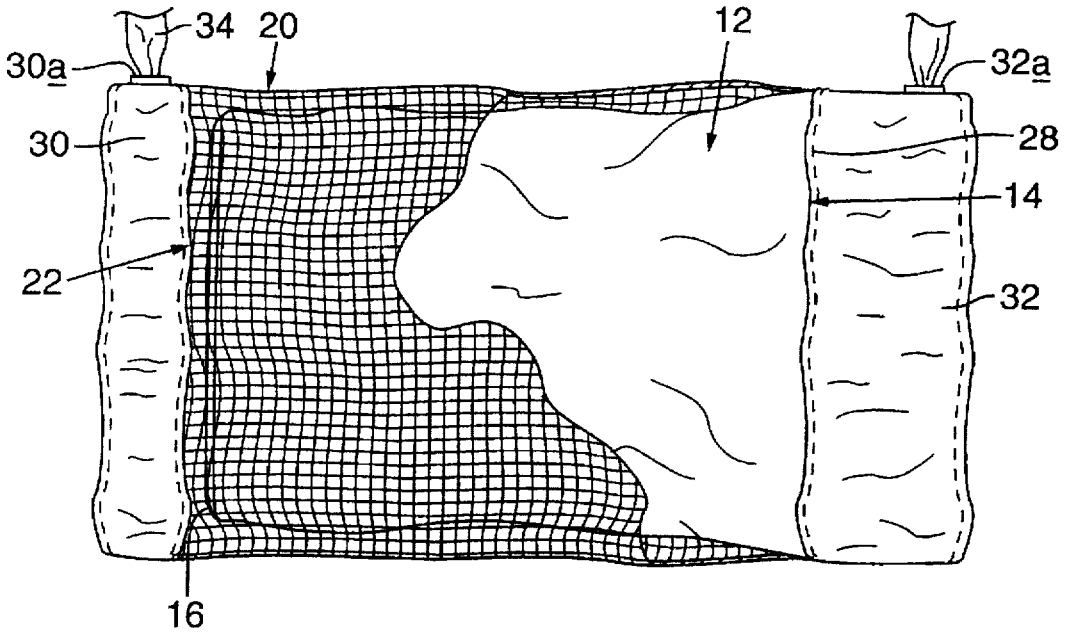
FIG. 3 is a side plan view of the bag of FIG. 1 which shows a bag configuration which is different from the configurations of both FIGS. 1 and/or 2.

A third configuration is shown in FIG. 3, and is one in which first bag 12 has been stuffed, bottom first (from the starting configuration of FIG. 1), into second bag 20. The bag openings 14, 22 respectively, face opposite directions for defining separate enclosures or compartments for receiving, holding, and carrying articles. A portion of bag 20 has been broken away to show bag 12 internally thereof. Articles desired to be carried in bag 20 may be inserted through opening 22, and articles desired to be carried in bag 12 may be inserted through opening 14. Because bag 12 has been stuffed inside bag 20 so that the respective openings face opposite directions, the articles, as between bags, are separated from one another. Hence, in this configuration, each enclosure prevents its respective held articles from commingling with articles in the other enclosure which is most helpful when different types of articles, such as wet and dry articles, are desired to be carried together.

The third configuration may be thought of as one in which the article-carrying volume of the primary carrying compartment is capable of being manipulated. More specifically, when bag 12 is stuffed inside of bag 20, the primary carrying compartment of FIG. 1 gives way to a secondary carrying compartment which is defined by bag 12. The secondary carrying compartment fits inside of the primary carrying compartment. In the preferred embodiment, first bag 12 is formed from a water-proof or water-resistant material such as nylon, and second bag 20 is formed from a mesh material. This enables both wet and dry articles to be carried by the bag in the primary and secondary compartments, respectively, without the dry articles becoming wet or damp. That is, dry articles may be placed in bag 12 and wet articles may be placed in bag 20. In addition to separating the wet and dry articles, wet or damp articles in bag 20 will air dry because the mesh bag is on the outside, and debris such as sand may be shaken from the articles and pass freely away therefrom. It will also be appreciated that wet articles could be placed in bag 12 and dry articles in bag 20. This would be desirable in situations where one wanted to carry the articles in a vehicle without fouling the interior. Bag 12, because of its waterproof nature, would prevent water or debris from the held articles from escaping into the vehicle interior. As mentioned above, the third configuration is achieved by stuffing bag 12 into bag 20. More specifically, one would start first with the bag as configured in FIG. 1. Then, by pushing bottom 16 of bag 12 toward top 14, through the opening defined by top 14, and into the central body portion 26 of bag 20, bag 12 is thereby reversed so that the outer bag surface shown in FIG. 1 now becomes the interior surface of the secondary carrying compartment. In situations where wet articles are carried in bag 12, the interior surface might become moist. By simply returning the bag to the starting configuration, the interior surface would become the exterior surface and any accumulated moisture would be allowed to evaporate.

Figure 4:
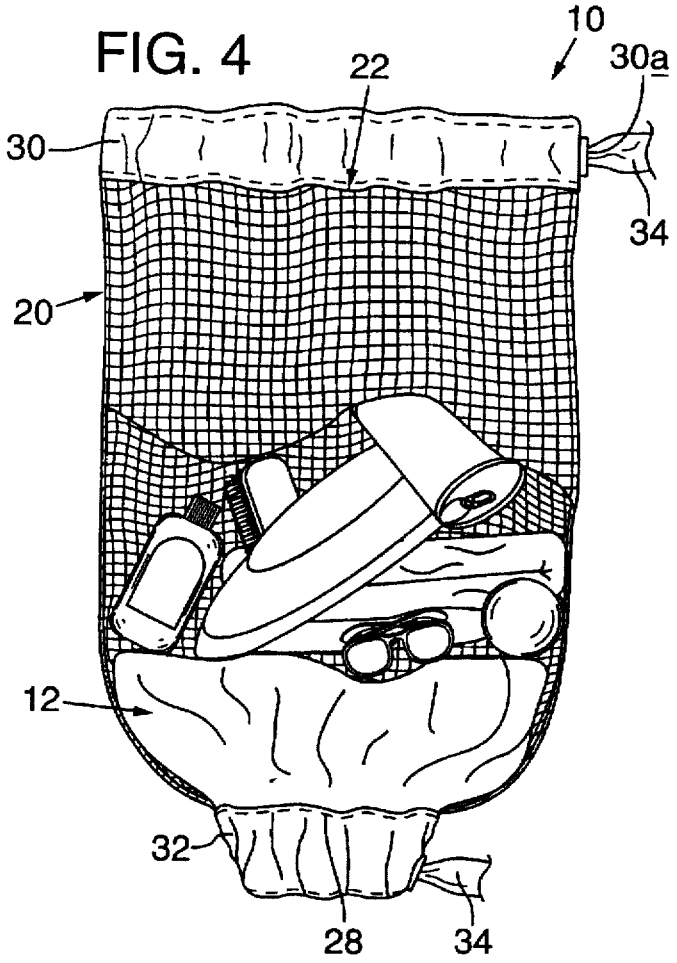
FIG. 4 is a side plan view of the bag of FIG. 1 which shows a bag configuration which is different from the configurations of FIGS. 1, 2, and/or 3.

A fourth configuration is shown in FIG. 4, and is one which follows from the configuration shown in FIG. 3 described just above. The fourth configuration might be called a variable-volume configuration in which first bag 12 is stuffed into second bag 20 (FIG. 3), and then mashed back down toward the joinder region and collar 32 for defining a floor region which is bi-directionally extendable on either side of the joinder region. It is bi-directionally extendable on either side of the joinder region because if bag 12 is pushed all of the way past the joinder region and away from top 22, it will be configured as in FIG. 1. If bag 12 is extended in the other direction (internally of bag 20), it will be configured as in FIG. 3. The fourth configuration, however, preferably strikes a medium between the two configurations just-mentioned, because the fourth configuration is preferably one in which bag 12 has been mashed all of the way down toward the joinder region for defining the floor of a substantially mesh bag. More specifically, by closing off collar 32 as shown, the combination of crumpled bag 12 and the closed-off collar define a floor of the mesh bag which enables the bag to be placed in a vertical orientation, i.e., set on a floor, for loading. Simply put, the mesh bag 20 may now be set upright for loading because the floor of the bag includes the entire crumpled bag 12 which is generally heavier than the mesh bag. This results in a low center of gravity which tends to keep the bag from tipping over when it is set vertically upright and loaded with articles. Additionally, the reason for the above-described placement of grommet pair 32*a* and the greater length dimension of collar 32 will now be understood to allow more room into which bag 12 may be stuffed for providing a greater mesh bag volume. That is, the dimensioning of collar 32 together with the placement of grommet pair 32*a* provides a space-enhancing feature because bag 12 may be stuffed all of the way to the bottom to ensure that the maximum mesh volume is available for carrying articles.

Figure 5:
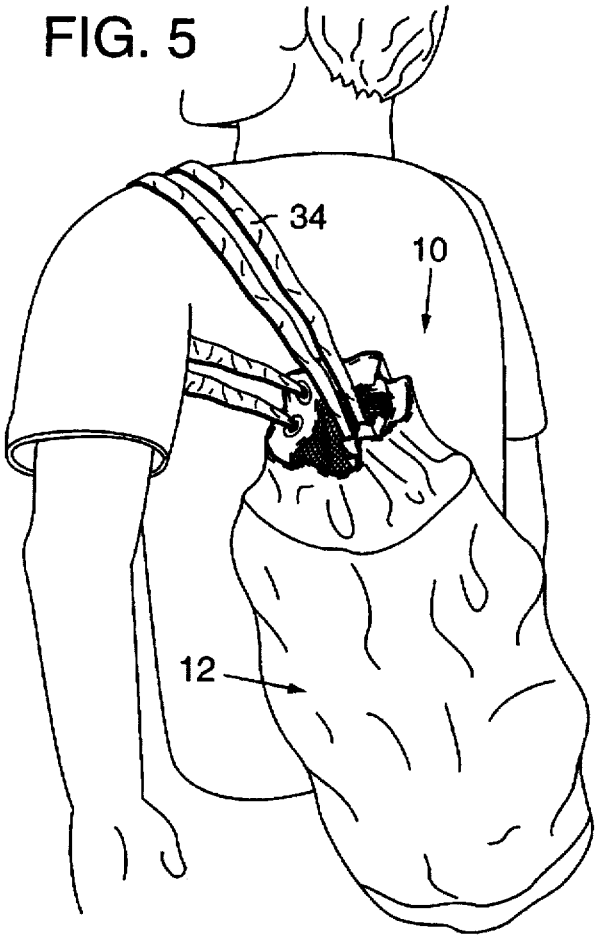
FIG. 5 shows the bag of FIG. 2 being carried on the shoulder of an individual.
Figure 6:
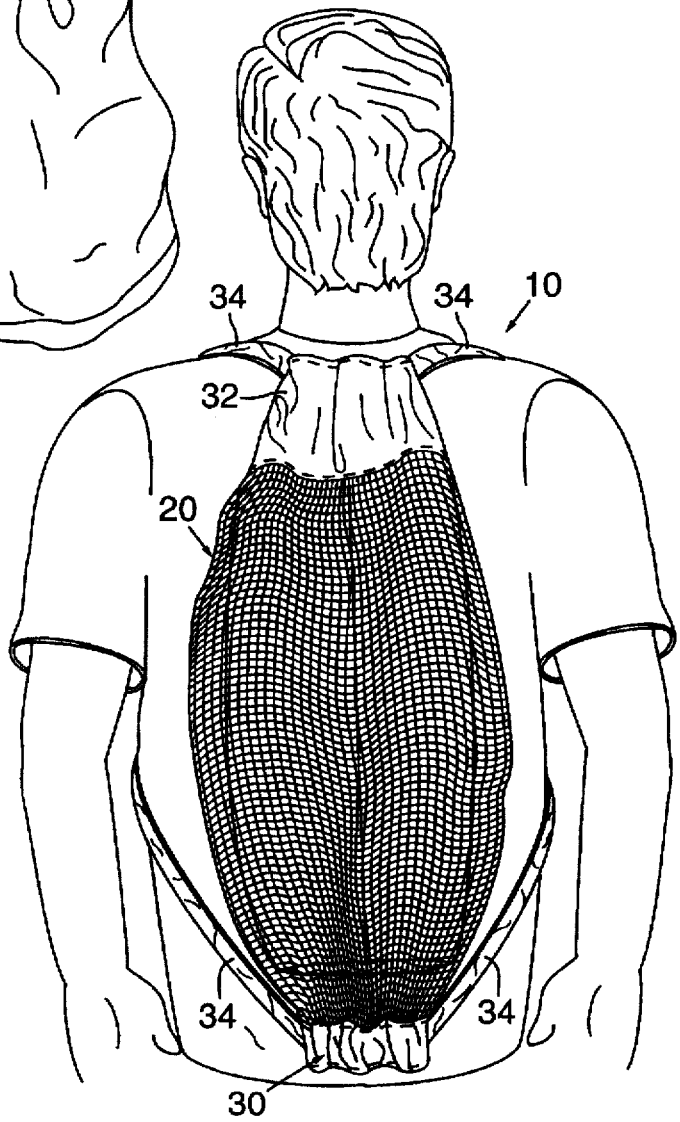
FIG. 6 shows the bag of FIG. 3 being carried in a backpack-like fashion on an individual's back.

Another feature of the invention which is most useful is that the closure member, and more specifically, strap run 34 not only serves to close off the bag in all of the configurations described above, but it also serves as the carrying straps by which the bag may be carried. Moreover, in addition to this dual role, i.e. closing and carrying, the straps are situated for enabling the bag to be carried in a number of ways. For example, a user may just simply grasp the straps and carry the bag in-hand. Alternatively, the bag may slung over a shoulder, as shown in FIG. 5, or carried like a backpack, as is shown in FIG. 6. This provides the user with multiple carrying options which, in turn, allow the bag to be transported in a number of different modes. For example, when the bag is hand-carried or slung over a shoulder, the user may simply walk from place-to-place carrying the bag thereabout. If, however, the user wishes to ride a bicycle or motorcycle to get from place to place, the backpack configuration is most helpful because first, the bag does not need to be hand-carried, and second, the bag will not slip off, as it might, were it to be slung over one shoulder while riding.

Construction of an article-carrying bag according to the preferred embodiment may be accomplished in the following manner. Initially, a rectangular sheet, preferably of mesh material, is joined as by sewing, along each long end to define a tubular, open-ended enclosure such as second bag 20. Two elongate sleeves 30, 32 are constructed, preferably from a durable material such as nylon, and two eyelets or grommets are provided in each of the sleeves. A suitably-formed, closed-bottom pouch 12 is connected, as by sewing, along joinder line 28 which directly connects the top of the pouch 12, an edge of sleeve 32, and one end of tubular enclosure 20 for defining the primary carrying compartment described above and shown in FIG. 1. Sleeve 30 is connected to the other end of enclosure 20 as by sewing, and the eyelets in each of the sleeves permit a run of strap to pass therethrough and loop circuitously around the bag for permitting the bag to be closed off or cinched by being gathering therealong as described above.

Briefly summarizing, an article-carrying bag has been described which includes a first bag having a top defining a first bag opening, a closed bottom, and a central body portion extending between the top and bottom. A second bag includes a top defining a second bag opening, a bottom, and a central body portion extending between the top and bottom. A joinder line connects the top of the first bag adjacent the bottom of the second bag such that the bags are capable of being configured in plural configurations including one in which the first bag extends away from the second bag and both openings face the same direction for defining a singular enclosure for receiving and holding articles, and another configuration in which the first bag may be stuffed into the second bag so the bag openings face opposite directions for defining separate enclosures for receiving and holding articles. Each separate enclosure prevents its respective held articles from commingling with articles in the other enclosure. Other configurations into which the bag may be placed are described. A closure member is preferably connected adjacent each bag top for enabling one or both of the bags to be closed. The closure member includes an elongate strap and a collar which is connected adjacent at least one of the bag tops, and preferably both, for receiving a portion of the strap which permits the bag top(s) to be gathered therealong for closing. In the preferred embodiment, the first bag is waterproof or water resistant, and the second bag is mesh.

While the present invention has been shown and described with reference to the foregoing preferred and alternate embodiments, it is to be understood by those skilled in the art that other changes in form and detail may be made therein without departing from the spirit and scope of the invention as defined in the appended claims.

It is claimed and desired to secure Letters Patent:

1. An article-carrying bag comprising:

a first bag having a top defining a first bag opening a closed bottom, and a central body portion extending therebetween;

a second bag having a top defining a second bag opening a bottom, and a central body portion extending therebetween; and a joinder line connecting the top of the first bag adjacent the bottom of the second bag such that the bags are capable of being configured in plural configurations including one in which the first bag extends away from the second bag and both openings face the same direction for defining a singular enclosure for receiving and holding articles, a second configuration in which the first bag may be stuffed into the second bag so the bag openings face opposite directions for defining separate enclosures for receiving and holding articles, and a third configuration in which the second bag may be stuffed into the first bag so the bag openings face opposite directions for defining separate enclosures for receiving and holding articles, wherein each separate enclosure prevents respective held articles from commingling with articles in the other enclosure.

2. The bag of claim 1 further comprising a closure connected adjacent each bag top for enabling either or both of the bags to be closed, regardless of the configuration of the bags.

3. The bag of claim 2, wherein the closure includes an elongate strap along which each respective bag top may be gathered for closing.

4. The bag of claim 3, wherein the closure includes at least one collar which is connected to one of the bag tops for receiving a portion of the strap and permitting the bag top to be gathered therealong for closing.

5. The bag of claim 3, wherein the strap includes at least one portion which extends between the bag tops and defines a carrying strap for enabling the bag to be carried.

6. The bag of claim 5, wherein the strap defines two carrying straps for enabling the bag to be carried like a backpack.

7. The bag of claim 1, wherein the first bag is waterproof.

8. The bag of claim 7, wherein the first bag is nylon.

9. The bag of claim 1, wherein the first bag is water-resistant and the second bag is mesh.

10. An article-carrying bag comprising:

a tubular, collapsible body region having a top defining an opening into a primary carrying compartment;

a floor region defining a bag bottom; and a closeable joinder region connecting the body and floor regions, the floor region being bi-directionally extendable on either side of the joinder region in first and second directions respectively, for varying the article-carrying volume of the primary carrying compartment, the first direction being generally away from the top and exteriorly of the body region for increasing the volume, and the second direction being generally toward the top and interiorly of the body region for reducing the volume and defining therewithin a secondary article-carrying compartment which is accessible from an opening which faces away from the primary compartment opening, the joinder region being closeable, in part, for selectively closing the secondary compartment, regardless of the direction in which the floor region is extended.

11. The bag of claim 10 further comprising a closure adjacent the top of the body region for closing the primary compartment.

12. The bag of claim 11, wherein the closure includes a collar and a strap which passes through the collar for permitting the top to be gathered therealong for closing off the primary compartment.

13. The bag of claim 12, wherein the joinder region includes a collar which is different from the collar adjacent the top, and wherein each collar receives a portion of the strap so that the strap loops around the bag and through each collar for defining dual closures, the strap further defining carrying straps for permitting the bag to be carried like a backpack.

14. The bag of claim 10, wherein the floor region is constructed from a water-resistant material so that when the floor region is extended in the second direction, the secondary compartment defines a water-resistant compartment for carrying wet articles in a manner which prevents commingling with articles carried in the primary carrying compartment.

15. The bag of claim 14, wherein the water-resistant material is nylon.

16. The bag of claim 14, wherein the body region is mesh-like.

17. An article-carrying bag comprising:

a sheet of material defining an open-ended, generally tubular enclosure with first and second ends;

a circuitous sleeve bounding each respective end of the enclosure;

a collapsible, closed-bottom pouch;

a joinder line directly connecting the pouch, the first end of the enclosure, and one of the sleeves so that the pouch may be stuffed into the enclosure for defining a configuration in which articles may be placed into the bag from either end and maintained without mixing and further wherein the pouch may be extended away from the enclosure for defining another configuration in which articles may be placed into the bag from the second end of the enclosure; and a continuous run of strap material, respective portions of which pass through each of the sleeves for enabling the sleeves, and hence the enclosure ends, to be gathered therealong for closing the enclosure and the pouch, and further wherein the strap run includes exposed portions which extend along the enclosure from end-to-end and define carrying straps by which the bag may be carried.

18. The bag of claim 17, wherein the enclosure is mesh.

19. The bag of claim 17, wherein the pouch is water-resistant.

20. The bag of claim 17, wherein the pouch is water-proof.

21. The bag of claim 17, wherein the pouch is nylon.

22. The bag of claim 17, wherein the bag is elongate.

23. The bag of claim 17, wherein the pouch is water-resistant and the enclosure is mesh.

24. The bag of claim 17, wherein the pouch is water-proof and the enclosure is mesh.

* * * * *